US011591934B2

(12) United States Patent
Kuwamura et al.

(10) Patent No.: US 11,591,934 B2
(45) Date of Patent: Feb. 28, 2023

(54) EXHAUST HOOD AND STEAM TURBINE

(71) Applicant: Mitsubishi Hitachi Power Systems, Ltd., Yokohama (JP)

(72) Inventors: Yoshihiro Kuwamura, Tokyo (JP); Hideaki Sugishita, Tokyo (JP); Kazuyuki Matsumoto, Tokyo (JP); Toyoharu Nishikawa, Tokyo (JP); Kei Nakanishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 287 days.

(21) Appl. No.: 16/760,934

(22) PCT Filed: Dec. 25, 2018

(86) PCT No.: PCT/JP2018/047571
§ 371 (c)(1),
(2) Date: May 1, 2020

(87) PCT Pub. No.: WO2019/131632
PCT Pub. Date: Jul. 4, 2019

(65) Prior Publication Data

US 2021/0180470 A1 Jun. 17, 2021

(30) Foreign Application Priority Data

Dec. 28, 2017 (JP) ..... JP2017-253815

(51) Int. Cl.
*F01D 25/30* (2006.01)
*F01D 9/02* (2006.01)

(52) U.S. Cl.
CPC ..... *F01D 25/30* (2013.01); *F01D 9/02* (2013.01); *F05D 2220/31* (2013.01);
(Continued)

(58) Field of Classification Search
CPC .. F01D 25/30; F05D 2220/31; F05D 2240/12; F05D 2240/14; F05D 2240/50; F05D 2240/70
See application file for complete search history.

(56) References Cited

U.S. PATENT DOCUMENTS 5,257,906 A 11/1993 Gray et al.
6,419,448 B1 * 7/2002 Owczarek ..... F01D 25/30 60/692

(Continued)

FOREIGN PATENT DOCUMENTS

JP 53-016703 U 2/1978
JP 57129206 A * 11/1982

(Continued)

OTHER PUBLICATIONS

International Search Report dated Mar. 26, 2019, issued in counterpart application No. PCT/JP2018/047571, with English Translation. (4 pages).

(Continued)

*Primary Examiner* — Michael Lebentritt
*Assistant Examiner* — Danielle M. Christensen
(74) *Attorney, Agent, or Firm* — WHDA, LLP

(57) ABSTRACT

An exhaust hood (Ec) of the present invention is provided with an inner casing (21), an outer casing (30), and a diffuser (26). The inner casing (21) surrounds a rotor from the outside in a radial direction, and forms a first space (21*s*) in which a fluid flows in an axial direction (Da) between the rotor and the inner casing (21). The diffuser (26) is provided with a bearing cone (29) that has a diameter that gradually widens moving towards an axial downstream side (Dad) and forms a cylindrical shape extending to the axial downstream side (Dad) to be continuous with the outer circumferential surface of a rotor shaft that forms the first space (21*s*). An end edge (29*a*) on the axial downstream side (Dad) of the (Continued)

bearing cone (29) forms an oval shape in which, in a direction orthogonal to an axial line (Ar), a distance (R2*an*) between the axial line (Ar) and a second cone end part (29*ab*) of a second side (Dan) is greater than a distance (R2*ex*) between the axial line (Ar) and a first cone end part (29*aa*) of a first side (Dex).

12 Claims, 13 Drawing Sheets

(52) U.S. Cl.
CPC ..... *F05D 2240/12* (2013.01); *F05D 2240/14* (2013.01); *F05D 2240/50* (2013.01); *F05D 2250/70* (2013.01)

(56) References Cited

U.S. PATENT DOCUMENTS

| | | | | |
|---|---|---|---|---|
| 2008/0063516 | A1* | 3/2008 | Fridsma | F01D 25/30 415/148 |
| 2019/0277163 | A1* | 9/2019 | Nishikawa | F01D 25/14 |

FOREIGN PATENT DOCUMENTS

| | | | |
|---|---|---|---|
| JP | 62-133903 | U | 8/1987 |
| JP | 08-260904 | A | 10/1996 |
| JP | 11-200814 | A | 7/1999 |
| JP | 2003-027905 | A | 1/2003 |
| JP | 2004-150357 | A | 5/2004 |
| JP | 2006-083801 | A | 3/2006 |
| JP | 2006-283587 | A | 10/2006 |
| JP | 2006-329148 | A | 12/2006 |
| JP | 2010-509534 | A | 3/2010 |
| JP | 2011-220125 | A | 11/2011 |
| JP | 2015-098824 | A | 5/2015 |
| WO | 2008/058821 | A1 | 5/2008 |
| WO | 2018/079805 | A1 | 5/2018 |

OTHER PUBLICATIONS

Written Opinion dated Mar. 26, 2019, issued in counterpart application No. PCT/JP2018/047571, with English Translation. (13 pages).

* cited by examiner

EXHAUST HOOD AND STEAM TURBINE

TECHNICAL FIELD

The present invention relates to an exhaust hood and a steam turbine.

This application claims the priority of Japanese Patent Application No. 2017-253815 filed in Japan on Dec. 28, 2017, the content of which is incorporated herein by reference.

BACKGROUND ART

There are many cases where rotary machines such as turbines or compressors include a diffuser downstream of the last rotor blade for recovering the pressure of the working fluid. In such a diffuser, the working fluid exhausted along an axis of a rotor shaft is formed to change a direction toward an outside in a radial direction about the rotor shaft, for example, due to the layout. There is a case where such a diffuser has a large exhaust loss due to a change in an exhaust direction.

Patent Literatures 1 and 2 suggest a technology that forms a bearing cone shape of the diffuser into an asymmetric form between an exhaust side and an opposite exhaust side of an outer casing in order to reduce the exhaust loss from the last rotor blade of a steam turbine to a condenser.

Patent Literature 3 suggests a technology in which a flow guide of a diffuser is formed asymmetrically between an exhaust side and an opposite exhaust side of an outer casing.

CITATION LIST

Patent Literature

[PTL 1] Japanese Unexamined Patent Application Publication No. 2006-083801

[PTL 2] Japanese Unexamined Patent Application Publication No. 2004-150357

[PTL 3] Japanese Unexamined Patent Application Publication No. 11-200814

SUMMARY OF INVENTION

Technical Problem

However, even when the exhaust loss is reduced as in Patent Literatures 1 to 3, a backflow occurs in the vicinity of the bearing cone on the opposite exhaust side, or delamination occurs in the flow guide on the exhaust side, there is a possibility that a pressure loss occurs.

The present invention has been made in view of the above-described circumstances, and provides an exhaust hood and a steam turbine that can reduce the pressure loss and improve the performance.

Solution to Problem

The following configuration is adopted to solve the above-described problem.

According to a first aspect of the present invention, the exhaust hood includes an inner casing, an outer casing, and a diffuser. The inner casing surrounds a rotor from an outside in a radial direction about an axis of a rotor shaft, and forms a first space in which a fluid flows in a direction in which the axis extends between the rotor and the inner casing. The outer casing surrounds the rotor and the inner casing, forms a second space to which the fluid flowing through the first space is discharged between the inner casing and the outer casing, and has an outlet on a first side in a direction orthogonal to the axis. The diffuser disposed on a downstream side of the inner casing to form a diffuser space communicating with the first space, is oriented radially outward as going toward the downstream side, and allows the first space and the second space to communicate with each other. The diffuser is provided with a bearing cone that forms a cylindrical shape extending to a downstream side in an axial direction to be continuous with an outer peripheral surface of the rotor shaft that forms the first space and has a diameter that gradually widens as going toward the downstream side in the axial direction. An end edge on the downstream side of the bearing cone forms an oval shape in which, in a direction orthogonal to the axial line, a distance between the axial line and a second cone end portion on a second side opposite to the first side is greater than a distance between the axial line and a first cone end portion on the first side.

At the end edge on the downstream side of the bearing cone according to the first aspect, in the direction orthogonal to the axial line, the distance between the axial line and the second cone end portion on the second side opposite to the first side is greater than the distance between the axial line and the first cone end portion on the first side. Accordingly, for example, in a case where the first cone end portion and the second cone end portion are at the same position in the axial direction, or in a case where the second cone end portion is disposed on the upstream side in the axial direction from the first cone end portion, an angle of the bearing cone with respect to the axis on the second side is greater than that on the first side. Therefore, the bearing cone can be formed to follow the flow of the fluid in the diffuser space on the second side. Meanwhile, in a case where the second cone end portion is positioned on the downstream side in the axial direction from the first cone end portion, the length of the diffuser space on the second side can be increased. Therefore, a region where a backflow occurs can be eliminated. Accordingly, the performance can be improved by reducing the pressure loss.

According to a second aspect of the present invention, the diffuser according to the first aspect may include a flow guide that forms a cylindrical shape extending to the downstream side in the axial direction from an end edge on the downstream side of the inner casing and has a diameter that gradually widens as going toward the downstream side in the axial direction. The flow guide may include a first guide section formed closer to the first side than the axis, and a second guide section formed closer to the second side than the axis. In a cross-sectional view including the axis, a radial distance between the axis and a second side guide end portion positioned on the most second side of the second guide section may be greater than a radial distance between the axis and the first guide section which is at the same position as the second side guide end portion in the axial direction. An angle between the axis and a tangent at the second side guide end portion may be greater than an angle between the axis and a tangent of the first guide section which is at the same position as the second side guide end portion in the axial direction.

With this configuration, it is possible to suppress a decrease in a flow path cross-sectional area on the second side in the diffuser space to be smaller than a flow path cross-sectional area on the first side. Therefore, it is possible to expand the effective flow path area as a diffuser space at the outlet of the diffuser, and to improve the pressure recovery performance of the diffuser.

According to a third aspect of the present invention, the diffuser according to the first aspect may include a flow guide that forms a cylindrical shape extending to the downstream side in the axial direction from an end edge on the downstream side of the inner casing and has a diameter that gradually widens as going toward the downstream side in the axial direction. The flow guide may include a first guide section formed closer to the first side than the axis, and a second guide section formed closer to the second side than the axis. In a cross-sectional view including the axis, an angle between the axis and a tangent of the second guide section is greater than an angle between the axis and a tangent of the first guide section which is at the same position as the second guide section in the axial direction.

With this configuration, it is possible to suppress a decrease in the flow path cross-sectional area on the second side in the diffuser space to be smaller than the flow path cross-sectional area on the first side. Therefore, it is possible to expand the effective flow path area as a diffuser space at the outlet of the diffuser, and to improve the pressure recovery performance of the diffuser.

According to a fourth aspect of the present invention, the first cone end portion on the first side according to the second or third aspect may be positioned on the downstream side in the axial direction from the second cone end portion on the second side.

In the diffuser space on the first side, the flow of the fluid discharged from the first space inside the inner casing is oriented in the axial direction, and thus, the bearing cone side is unlikely to be delaminated. Therefore, by positioning the first cone end portion on the first side on the downstream side in the axial direction from the second cone end portion on the second side, an effective flow path cross-sectional area as a diffuser space on the first side can be expanded.

According to a fifth aspect of the present invention, the diffuser according to the first aspect may include a flow guide that forms a cylindrical shape extending to the downstream side in the axial direction from an end edge on the downstream side of the inner casing and has a diameter that gradually widens as going toward the downstream side in the axial direction and. The flow guide may include a first guide section formed closer to the first side than the axis, and a second guide section formed closer to the second side than the axis. The second cone end portion may be disposed on the downstream side in the axial direction from the first cone end portion. Furthermore, the second guide section according to the first aspect may have a longer length in the axial direction than that of the first guide section.

With this configuration, since the length of the bearing cone and the length of the flow guide on the second side can be respectively increased, the length of the diffuser space on the second side can be increased. Therefore, it is possible to suppress the occurrence of the backflow on the bearing cone side, and to improve the pressure recovery performance of the diffuser.

According to a sixth aspect of the present invention, in the bearing cone according to the first aspect, an end portion having a largest distance from the axis is disposed at a position shifted forward in a rotational direction of the rotor shaft from a position on the most second side in a circumferential direction with the axis as the center.

With this configuration, for example, in a case where a flow including a turning component flows into the diffuser from the last rotor blade of the rotor, in the bearing cone, the end portion having the largest distance from the axis can be disposed at a position at which a backflow region is most likely to be generated. Therefore, the pressure loss in the diffuser can be effectively reduced.

According to a seventh aspect of the present invention, a steam turbine includes the exhaust hood according to any one of the first to sixth aspects.

With this configuration, the efficiency of the steam turbine can be improved.

Advantageous Effects of Invention

According to the above-described exhaust hood and the steam turbine, the performance can be improved by reducing the pressure loss.

DESCRIPTION OF EMBODIMENTS

Next, an exhaust hood and a steam turbine according to embodiments of the present invention will be described with reference to the drawings.

First Embodiment

Figure 1:
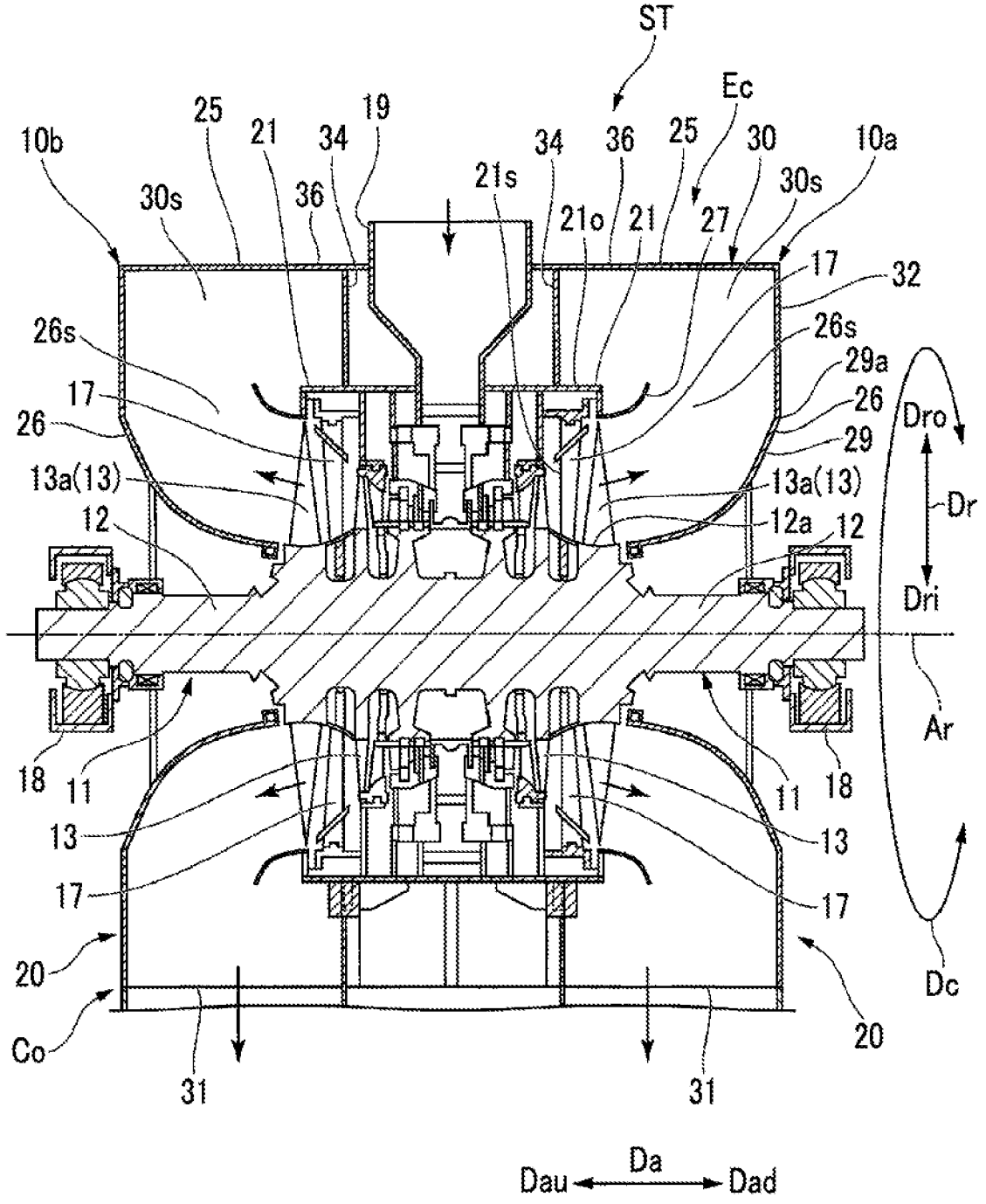
FIG. 1 is a view illustrating a schematic configuration of a steam turbine according to a first embodiment of the present invention.

FIG. 1 is a view illustrating a schematic configuration of a steam turbine according to a first embodiment of the present invention.

As illustrated in FIG. 1, a steam turbine ST of the first embodiment is a two-way exhaust type steam turbine. The steam turbine ST includes a first steam turbine section 10*a* and a second steam turbine section 10*b*. Each of the first steam turbine section 10*a* and the second steam turbine section 10*b* has a turbine rotor (rotor) 11 that rotates about an axis Ar, a casing 20 that covers the turbine rotor 11, and a plurality of stator blade rows 17 fixed to the casing 20, and a steam inlet duct 19. In the following description, a circumferential direction about the axis Ar is simply referred to as a circumferential direction Dc, and a direction perpendicular to the axis Ar is referred to as a radial direction Dr. Furthermore, a side toward the axis Ar in the radial direction Dr is defined as a radial inner side Dri, and a side opposite thereto is defined as a radial outer side Dro.

The first steam turbine section 10*a* and the second steam turbine section 10*b* share the steam inlet duct 19. Except for the steam inlet duct 19, the first steam turbine section 10*a* is disposed on one side in the axial direction Da with the steam inlet duct 19 as a reference. Except for the steam inlet duct 19, the second steam turbine section 10*b* is disposed on the other side in the axial direction Da with the steam inlet duct 19 as a reference. Here, the configuration of the first steam turbine section 10*a* and the configuration of the second steam turbine section 10*b* are basically the same. Therefore, in the following description, the first steam turbine section 10*a* will be mainly described, and the description of the second steam turbine section 10*b* will be omitted. In the first steam turbine section 10*a*, the side of the steam inlet duct 19 in the axial direction Da is defined as an axial upstream side Dau, and a side opposite thereto is defined as an axial downstream side Dad.

The turbine rotor 11 has a rotor shaft 12 extending in the axial direction Da about the axis Ar, and a plurality of rotor blade rows 13 attached to the rotor shaft 12. The turbine rotor 11 is supported by a bearing 18 to be rotatable about the axis Ar. The plurality of rotor blade rows 13 are arranged in the axial direction Da. Each of the plurality of rotor blade rows 13 is configured with a plurality of rotor blades arranged in the circumferential direction Dc. The turbine rotor 11 of the first steam turbine section 10*a* and the turbine rotor 11 of the second steam turbine section 10*b* are positioned on the same axis Ar and connected to each other, and rotate integrally about the axis Ar.

The casing 20 has an inner casing 21 and an exhaust casing 25.

The inner casing 21 forms a first space 21*s* that forms an annular shape about the axis Ar, between the rotor shaft 12 and the inner casing 21. The steam (fluid) flowing from the steam inlet duct 19 flows through the first space 21*s* in the axial direction Da (more specifically, toward the axial downstream side Dad). The plurality of rotor blade rows 13 of the turbine rotor 11 are arranged in the first space 21*s*. The plurality of stator blade rows 17 are arranged in the first space 21*s* along the axial direction Da. Each of the plurality of stator blade rows 17 is arranged on the axial upstream side Dau of any one rotor blade row 13 among the plurality of rotor blade rows 13. The plurality of stator blade rows 17 are fixed to the inner casing 21.

The exhaust casing 25 has a diffuser 26 and an outer casing 30.

The outer casing 30 surrounds the turbine rotor 11 and the inner casing 21, and forms a second space 30*s* to which the steam flowing through the first space 21*s* is discharged, between the inner casing 21 and the outer casing 30. The second space 30*s* communicates with the diffuser 26 and expands on the outer peripheral side of the diffuser 26 in the circumferential direction Dc. The outer casing 30 guides the steam flowing from a diffuser space 26*s* into the second space 30*s*, to the exhaust port 31.

The outer casing 30 has an exhaust port (outlet) 31 on a first side (lower side in FIG. 1) in a direction orthogonal to the axis Ar. The outer casing 30 illustrated in the present embodiment is open vertically downward. The steam turbine ST of the present embodiment is a so-called downward exhaust type condensing steam turbine, and a condenser (not illustrated) for returning steam to water is connected to the exhaust port 31. The outer casing 30 in the present embodiment includes a downstream end plate 32, an upstream end plate 34, and a side peripheral plate 36, respectively.

The downstream end plate 32 expands from the edge of the bearing cone 29 on the radial outer side Dro to the radial outer side Dro, and defines the edge of the second space 30*s* on the axial downstream side Dad.

The upstream end plate 34 is disposed to be closer to the axial upstream side Dau than the diffuser 26. The upstream end plate 34 expands from the outer peripheral surface 21*o* of the inner casing 21 to the radial outer side Dro, and defines the edge of the second space 30*s* on the axial upstream side Dau.

The side peripheral plate 36 is connected to the downstream end plate 32 and the upstream end plate 34, expands in the axial direction Da and expands in the circumferential direction Dc about the axis Ar, and defines the edge of the second space 30*s* on the radial outer side Dro.

The diffuser 26 is disposed on the axial downstream side Dad of the inner casing 21, and allows the first space 21*s* and the second space 30*s* to communicate with each other. The diffuser 26 forms the annular diffuser space 26*s* that gradually moves radially outward as going toward the axial downstream side Dad. The steam that has flowed out from a last rotor blade row 13*a* of the turbine rotor 11 toward the axial downstream side Dad flows into the diffuser space 26*s*. Here, the last rotor blade row 13*a* is a rotor blade row 13 that is disposed on the most axial downstream side Dad among a plurality of rotor blade rows 13 included in the first steam turbine section 10*a*.

The diffuser 26 includes a flow guide (or a steam guide, also referred to as an outer diffuser) 27 that defines the edge of the diffuser space 26*s* on the radial outer side Dro, and a bearing cone (or referred to as an inner diffuser) 29 that defines the edge of the diffuser space 26*s* on the radial inner side Dri.

The bearing cone 29 is formed in a cylindrical shape extending to the axial downstream side Dad to be continuous with an outer peripheral surface 12*a* of the rotor shaft 12 that forms the first space 21*s*. The bearing cone 29 has a ring-shaped cross section perpendicular to the axis Ar, and the diameter thereof gradually widens toward the radial outer side Dro as going toward the axial downstream side Dad. An end edge 29*a* of the bearing cone 29 is connected to the downstream end plate 32 of the outer casing 30.

The flow guide 27 has a cylindrical shape extending from the end edge of the inner casing 21 on the axial downstream side Dad as going toward the axial downstream side Dad. The flow guide 27 has a ring-shaped cross section perpendicular to the axis Ar, and the diameter thereof gradually widens toward the axial downstream side Dad. The flow guide 27 in the present embodiment is connected to the inner casing 21.

An exhaust hood Ec in the present invention includes the inner casing 21, the outer casing 30, and the diffuser 26.

Figure 2:
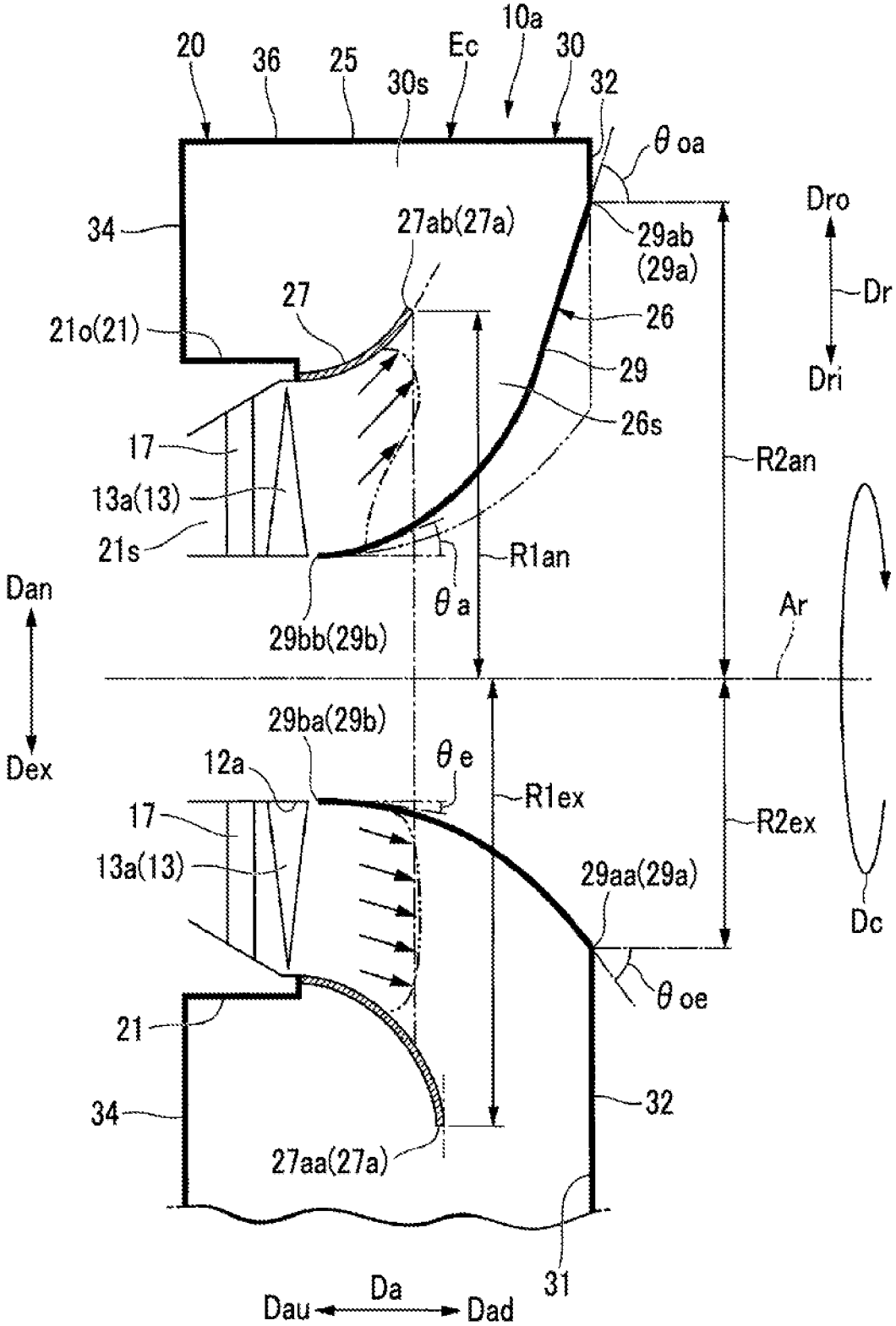
FIG. 2 is an enlarged view of an exhaust hood according to the first embodiment of the present invention.

FIG. 2 is an enlarged view of the exhaust hood according to the first embodiment of the present invention.

Figure 3:
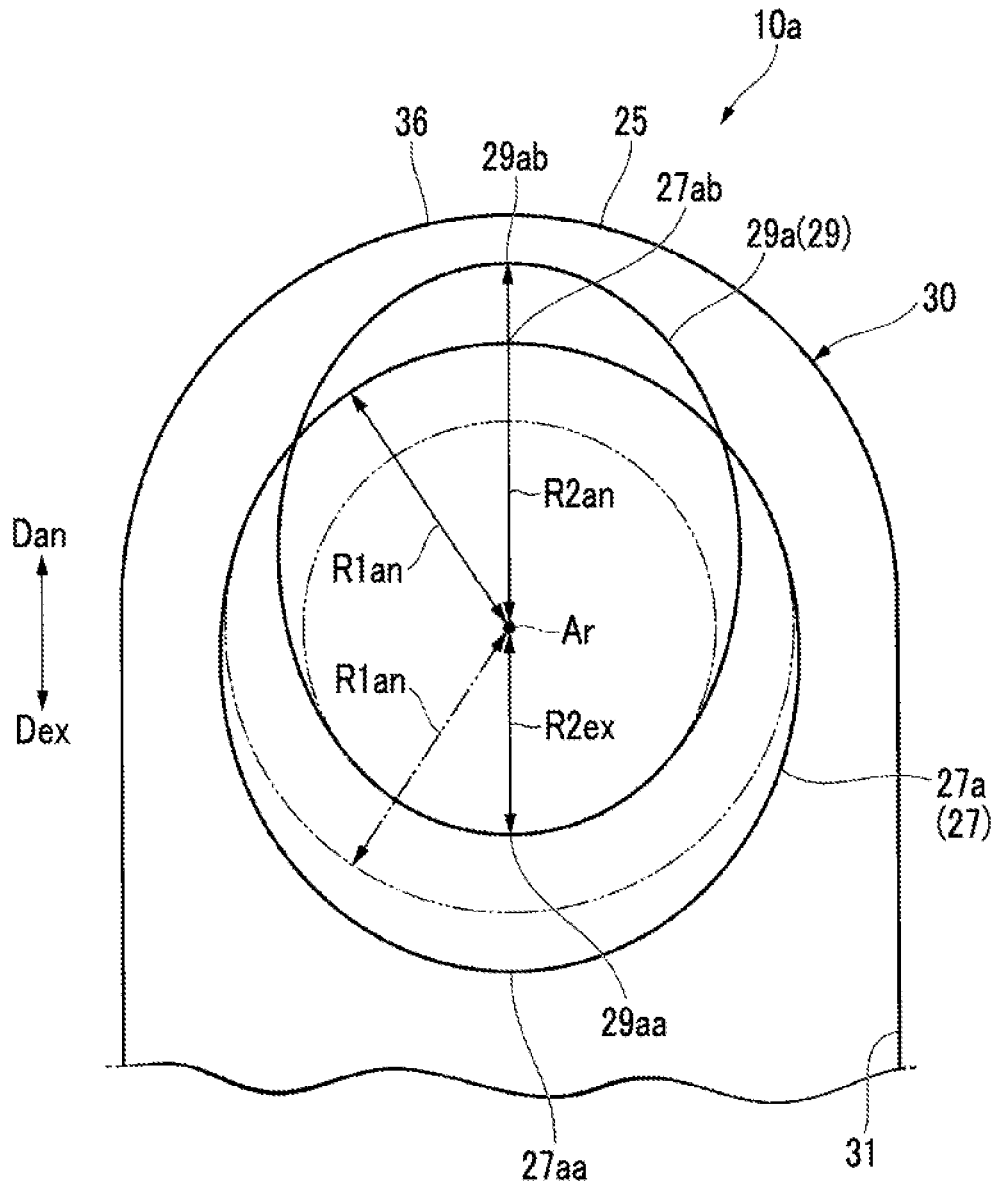
FIG. 3 is a view illustrating an outer shape of a bearing cone and a flow guide when viewed from an axial direction in the first embodiment of the present invention.

FIG. 3 is a view illustrating an outer shape of the bearing cone and the flow guide when viewed from the axial direction in the first embodiment of the present invention.

Here, as illustrated in FIG. 2, since the exhaust port 31 is disposed only on one side (first side) of the direction orthogonal to the axis Ar, the exhaust hood Ec has an asymmetric shape in the circumferential direction Dc, and the pressure distribution in the circumferential direction occurs. Then, as illustrated in FIG. 2, on the side (second side) opposite to the side where the exhaust port 31 is disposed, the flow of the steam discharged from the first space 21*s* moves toward the radial outer side Dro, and the flow rate distribution (illustrated by the two-dot chain line and the arrow inside the diffuser 26 in FIG. 2) is biased to the flow guide 27 side. In the following description, a first side area on which the exhaust port 31 is installed with respect to the axis Ar, which is one side in the direction orthogonal to the axis Ar, is referred as an exhaust side Dex, and a second side area which is opposite to the exhaust port 31 with respect to the axis Ar is referred as an opposite exhaust side Den, and the side opposite to the exhaust port 31 across the axis Ar is referred to as an opposite exhaust side Dan (the same applies to the second and subsequent embodiments).

In the flow guide 27 of the first embodiment, the shape of the cross section (hereinafter, referred to as a cross section including the axis Ar) by a virtual plane including the axis Ar is formed in a curved surface shape protruding toward the axis Ar.

Furthermore, in the first embodiment, the surface length of the flow guide 27 in a cross section including the axis Ar of the flow guide 27 is formed such that the exhaust side Dex is longer than the opposite exhaust side Dan. Accordingly, while the angle between the axis Ar and the tangent (illustrated by the chain line in FIG. 2) at an end edge 27*a* is approximately 90 degrees on the exhaust side Dex, the angle on the opposite exhaust side Dan is smaller than that on the exhaust side Dex.

The position of the end edge 27*a* on the exhaust side Dex in the axial direction Da is disposed on the axial downstream side Dad from the position of the end edge 27*a* on the opposite exhaust side Dan. At the end edges 27*a* of the flow guide 27, a distance R1*ex* between the axis Ar and an exhaust side guide end portion 27*aa* positioned on the most exhaust side Dex is longer than a distance R1*an* between the axis Ar and an opposite exhaust side guide end portion 27*ab* positioned on the most opposite exhaust side Dan.

As illustrated in FIG. 3, the end edge 27*a* of the flow guide 27 in the first embodiment is formed in a semicircular shape in a half portion on the opposite exhaust side Dan of the axis Ar, and in the half portion on the exhaust side Dex of the axis Ar, the end edge 27*a* is elongated to the exhaust side Dex from the radius (the position illustrated by the two-dot chain line in FIG. 3) of the half circle of the half portion on the opposite exhaust side Dan. In other words, the end edge 27*a* of the flow guide 27 has an oval shape that is elongated toward the exhaust side Dex from the opposite exhaust side Dan when viewed from the axial direction Da. In addition, a case where the end edge 27*a* of the flow guide 27 is formed in an oval shape and is formed asymmetrically on the exhaust side Dex and the opposite exhaust side Dan when viewed from the axial direction Da has been described. However, the end edge 27*a* of the flow guide 27 may be formed in a circular shape when viewed from the axial direction Da. Further, the flow guide 27 may be formed symmetrically on the exhaust side Dex and on the opposite exhaust side Dan.

As illustrated in FIG. 2, in the cross section including the axis Ar, the bearing cone 29 is formed in a curved surface shape protruding toward the axis Ar side. The position of the end edge 29*a* of the bearing cone 29 in the axial direction Da is the same throughout the entire circumference in the circumferential direction Dc. At the end edge 29*a* of the bearing cone 29 on the axial downstream side Dad, when viewed in the axial direction Da, in the direction (that is, an orthogonal direction about the axis Ar) orthogonal to the axis Ar, a distance R2*an* between the axis Ar and a second cone end portion 29*ab* on the opposite exhaust side Dan has a greater oval shape than that of a distance R2*ex* between the axis Ar and a first cone end portion 29*aa* on the exhaust side Dex.

At the same position in the axial direction Da, the angle between the axis Ar and the tangent (illustrated by the chain line in FIG. 2) in the vicinity of the end edge 29*b* of the bearing cone 29 on the axial upstream side Dau is greater on the opposite exhaust side Dan than that on the exhaust side Dex. Specifically, at the end edge 29*b* on the axial upstream side Dau, an angle θe between the axis Ar and the tangent at an end portion 29*ba* on the exhaust side Dex satisfies $\theta e \geq 0$. In addition, at the end edge 29*b* on the axial upstream side Dau, an angle θa between the axis Ar and the tangent at an end portion 29*bb* on the opposite exhaust side Dan satisfies $\theta a \geq \theta e \geq 0$. Hereinafter, the angle between the axis Ar and the tangent is simply referred to as an angle of the tangent.

Regarding the angle of the tangent (illustrated by the chain line in FIG. 2) at the end edge 29*a* of the bearing cone 29, an angle θoa of the tangent at the second cone end portion 29*ab* on the opposite exhaust side Dan is greater than the angle θoe of the tangent at the first cone end portion 29*aa* on the exhaust side Dex ($\theta oa > \theta oe$). In FIG. 2, the angles θoa and θoe are respectively illustrated as angles with respect to a virtual line (illustrated by the chain line in FIG. 2) parallel to the axis Ar (the same applies to the second and subsequent embodiments).

Here, on the opposite exhaust side Dan (upper side in FIG. 2) of FIG. 2, the two-dot chain line illustrated by the axial downstream side Dad of the bearing cone 29 illustrates a case (comparative example) in which the shape of the bearing cone 29 on the exhaust side Dex is adopted at the entire circumference in the circumferential direction Dc about the axis Ar. In other words, in the above-described first embodiment, the position of the bearing cone 29 on the opposite exhaust side Dan moves to the axial upstream side Dau as compared with the comparative example.

According to the above-described first embodiment, at the end edge 29*a* of the bearing cone on the axial downstream side Dad, the distance R2*an* between the axis Ar and the second cone end portion 29*ab* on the opposite exhaust side Dan is greater than the distance R2*ex* between the axis Ar and the first cone end portion 29*aa* on the exhaust side Dex. Accordingly, for example, in a case where the first cone end portion 29*aa* and the second cone end portion 29*ab* are disposed at the same position in the axial direction Da, regarding the angle of the tangent of the bearing cone 29 with respect to the axis Ar, the angle Ga of the tangent on the opposite exhaust side Dan is greater than the angle θe of the tangent on the exhaust side Dex. Therefore, the bearing cone 29 can be formed to follow the flow of the steam in the diffuser space 26*s* on the opposite exhaust side Dan side. Therefore, it is possible to eliminate the region where the backflow occurs on the opposite exhaust side Dan. As a result, the pressure loss in the diffuser 26 can be reduced and the performance can be improved.

Second Embodiment

Next, a second embodiment of the present invention will be described with reference to the drawings. The second embodiment is different from the above-described first embodiment in the shape of the flow guide on the opposite exhaust side Dan and the shape of the flow guide on the exhaust side Dex. Therefore, the same reference numerals will be given to the same parts as those of the above-described first embodiment, and the redundant description thereof will be omitted.

Figure 4:
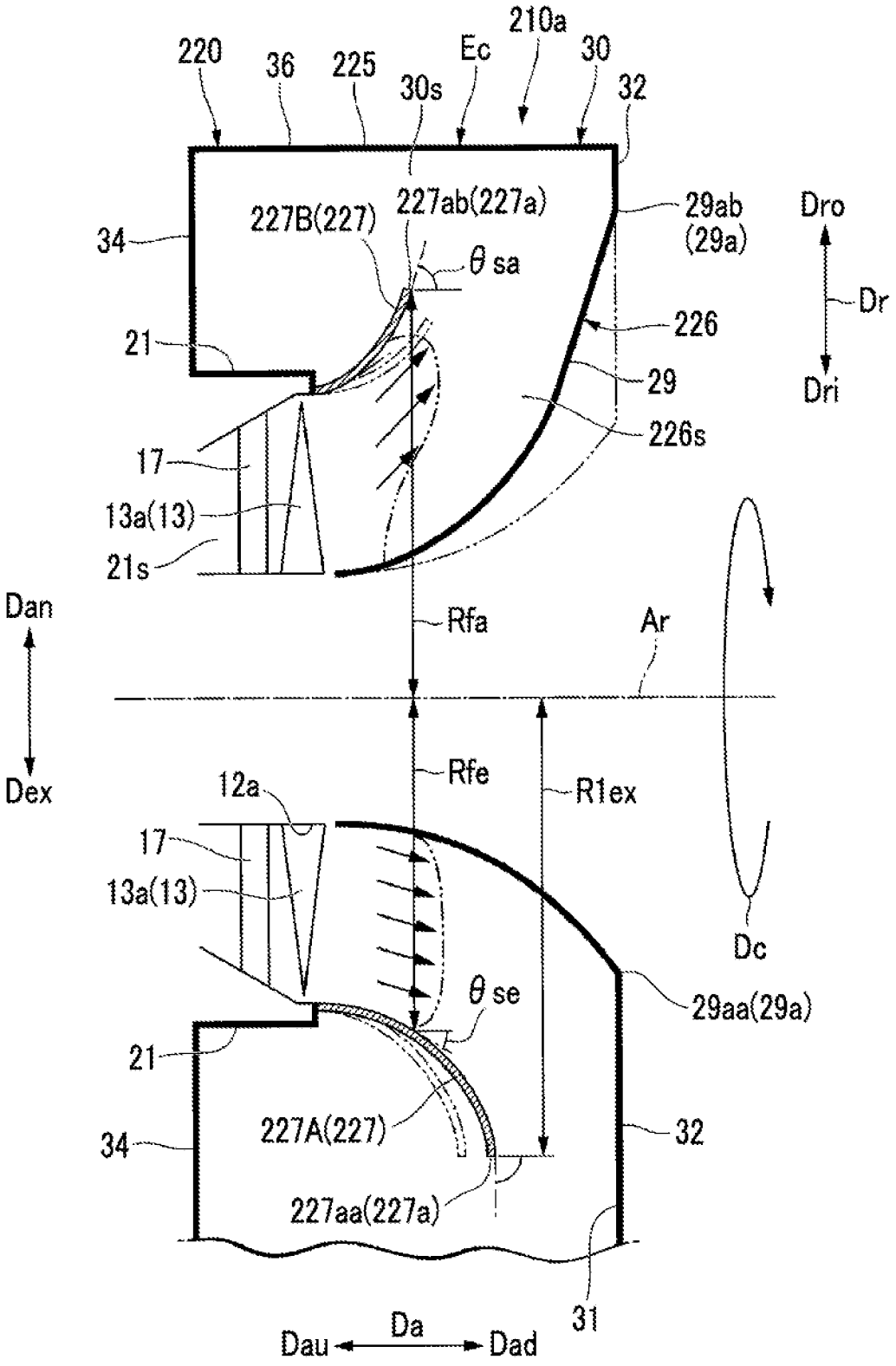
FIG. 4 is a view corresponding to FIG. 2 in a second embodiment of the present invention.
Figure 5:
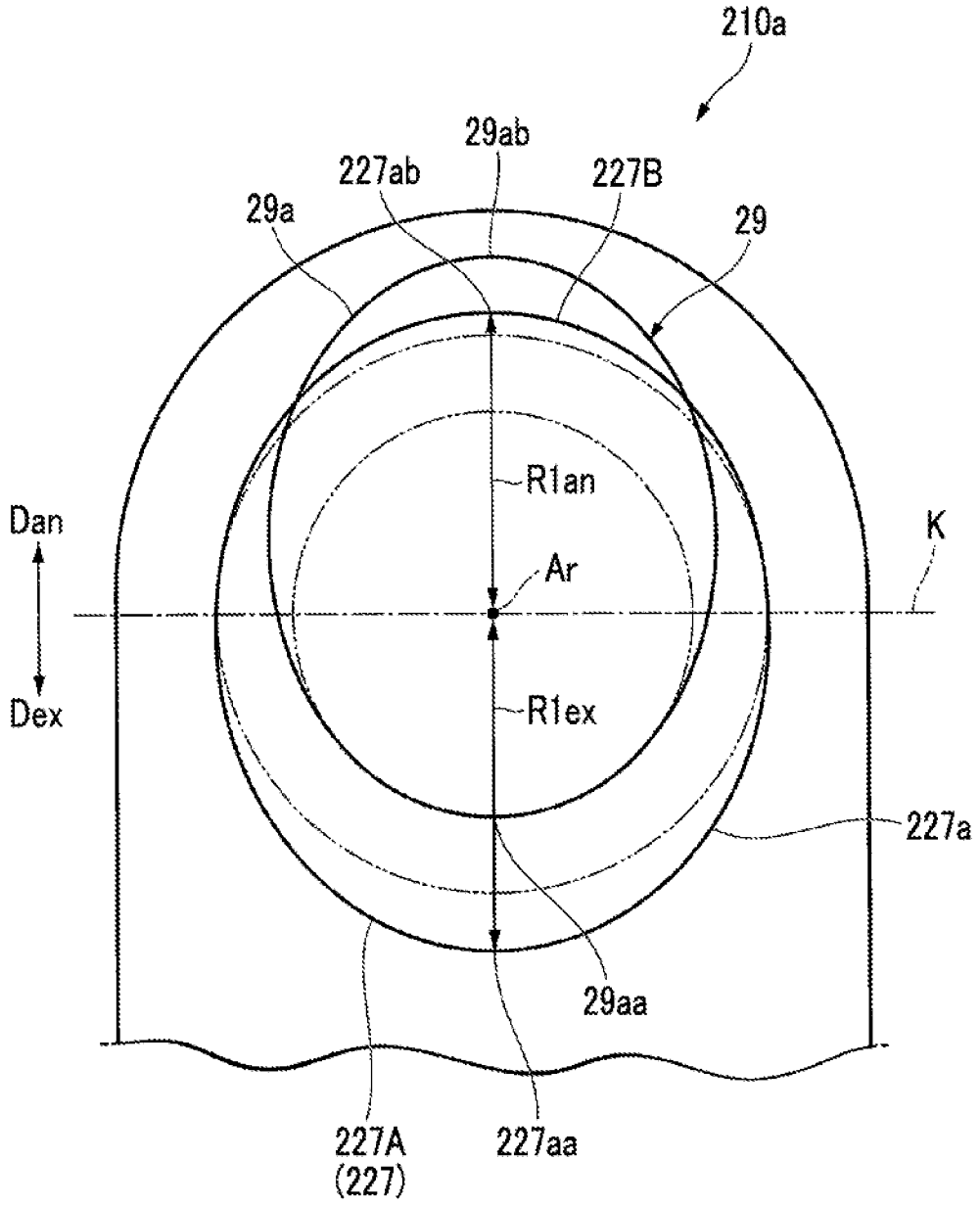
FIG. 5 is a view corresponding to FIG. 3 in the second embodiment of the present invention.

FIG. 4 is a view corresponding to FIG. 2 in the second embodiment of the present invention. FIG. 5 is a view corresponding to FIG. 3 in a first modification example of the second embodiment of the present invention.

As illustrated in FIGS. 4 and 5, similar to the above-described first embodiment, a casing 220 of a first steam turbine section 210*a* in the second embodiment has the inner casing 21 and an exhaust casing 225. The exhaust casing 225 has a diffuser 226 and the outer casing 30.

The diffuser 226 is disposed on the axial downstream side Dad of the inner casing 21, and allows the first space 21*s* and the second space 30*s* to communicate with each other. The diffuser 226 forms an annular diffuser space 226*s* that gradually moves radially outward as going toward the axial downstream side Dad. The steam that has flowed out from the last rotor blade row 13*a* of the turbine rotor 11 toward the axial downstream side Dad flows into the diffuser space 226*s*.

The diffuser 226 includes a flow guide 227 that defines the edge of the diffuser space 226*s* on the radial outer side Dro, and the bearing cone 29 that defines the edge of the diffuser space 226*s* on the radial inner side Dri. Since the bearing cone 29 has the same configuration as that of the first embodiment, a detailed description thereof will be omitted.

The flow guide 227 has a cylindrical shape extending from the end edge of the inner casing 21 on the axial downstream side Dad as going toward the axial downstream side Dad. The flow guide 227 has a ring-shaped cross section perpendicular to the axis Ar, and the diameter thereof gradually widens as going toward the axial downstream side Dad. The flow guide 227 in the second embodiment is connected to the inner casing 21. Here, in order to facilitate connection (or assembly) between the flow guide 227 and the inner casing 21, there is a case where a cylindrical part that is formed integrally with the flow guide 227 and extends in the axial direction Da is present between the flow guide 227 and the inner casing 21. Since the cylindrical part does not function as the diffuser 226, the part is not included in the flow guide 227 (the same applies to each embodiment and each modification example).

In the flow guide 227 according to the second embodiment, similar to the first embodiment, the cross-sectional shape including the axis Ar is formed into a curved surface shape protruding toward the axis Ar. Furthermore, in the second embodiment, the surface length of the flow guide 27 in the cross section including the axis Ar of the flow guide 27 is formed to be longer on the exhaust side Dex than that on the opposite exhaust side Dan. Accordingly, while the angle of the tangent (illustrated by the chain line in FIG. 4) at an end edge 227*a* is approximately 90 degrees on the exhaust side Dex, the angle ($\theta sa$) on the opposite exhaust side Dan is smaller than that on the exhaust side Dex.

The flow guide 227 includes a first guide section 227A on the exhaust side Dex of the axis Ar, and includes a second guide section 227B on the opposite exhaust side Dan of the axis Ar. The first guide section 227A and the second guide section 227B have an asymmetric shape.

The position of the end edge 227*a* on the exhaust side Dex in the axial direction Da is disposed on the axial downstream side Dad from the position of the end edge 227*a* on the opposite exhaust side Dan. At the end edge 227*a* of the flow guide 27, the distance R1*ex* between the axis Ar and an exhaust side guide end portion 227*aa* positioned on the most exhaust side Dex is longer than the distance Rfa (=R1*an*) between the axis Ar and an opposite exhaust side guide end portion 227*ab* positioned on the most opposite exhaust side Dan in the radial direction Dr.

As illustrated in FIG. 5, the end edge 227*a* of the flow guide 227 in the second embodiment is formed in an oval shape which is elongated to the opposite exhaust side Dan or elongated to the exhaust side Dex, more than the distance at which the distance between the axis Ar and the end edge 227*a* is the shortest. The length R1*ex* of the oval in the first guide section 227A in the elongated radial direction is formed to be longer than the length R1*an* of the oval in the second guide section 227B in the elongated radial direction.

The distance Rfa (=R1*an*) between the axis Ar and the opposite exhaust side guide end portion 227*ab* positioned on the most opposite exhaust side Dan is greater than the distance Rfe between the axis Ar and the first guide section 227A which is at the same position as the opposite exhaust side guide end portion 227*ab* in the axial direction Da, in the radial direction Dr (Rfa>Rfe). An angle $\theta se$ of the tangent in the first guide section 227A at the same position as the opposite exhaust side guide end portion 227*ab* in the axial direction Da is smaller than the angle $\theta sa$ of the tangent at the opposite exhaust side guide end portion 227*ab* ($\theta se<\theta sa$). In other words, the angle $\theta sa$ of the tangent at the opposite exhaust side guide end portion 227*ab* is greater than the angle $\theta se$ of the tangent at the first guide section 227A at the same position as the opposite exhaust side guide end portion 227*ab* in the axial direction Da.

Here, in FIG. 4, a comparative example in which the second guide section 227B is formed at the same angle as that of the flow guide 27 of the first embodiment on the opposite exhaust side Dan is illustrated by the two-dot chain line. In other words, by forming the second guide section 227B as described above, the dimension of the second guide section 227B in the axial direction Da is shorter than the dimension of the first guide section 227A in the axial direction Da. Furthermore, the position of the opposite exhaust side guide end portion 227*ab* of the second guide section 227B can be disposed further on the axial upstream side Dau and on the radial outer side Dro compared to the comparative example. In FIG. 4, the arrangement of the flow guide 27 in the above-described first embodiment is illustrated by the two-dot chain line on the axial upstream side Dau of the first guide section 227A.

By doing so, the angle of the tangent at the same position in the axial direction Da in the first guide section 227A is smaller than the angle (not illustrated) of the tangent of the flow guide 227 at a boundary position K (refer to FIG. 5) between the first guide section 227A and the second guide section 227B.

Therefore, according to the second embodiment, since the first guide section 227A extends to the axial downstream side Dad and follows the flow of steam, in the diffuser space 226*s* on the exhaust side Dex, the occurrence of delamination on the first guide section 227A side can be more suppressed than the second guide section 227B.

First Modification Example of Second Embodiment

Next, a first modification example of the second embodiment of the present invention will be described with reference to the drawings. The same reference numerals will be given to the same parts as those of the above-described second embodiment, and the redundant description thereof will be omitted.

Figure 6:
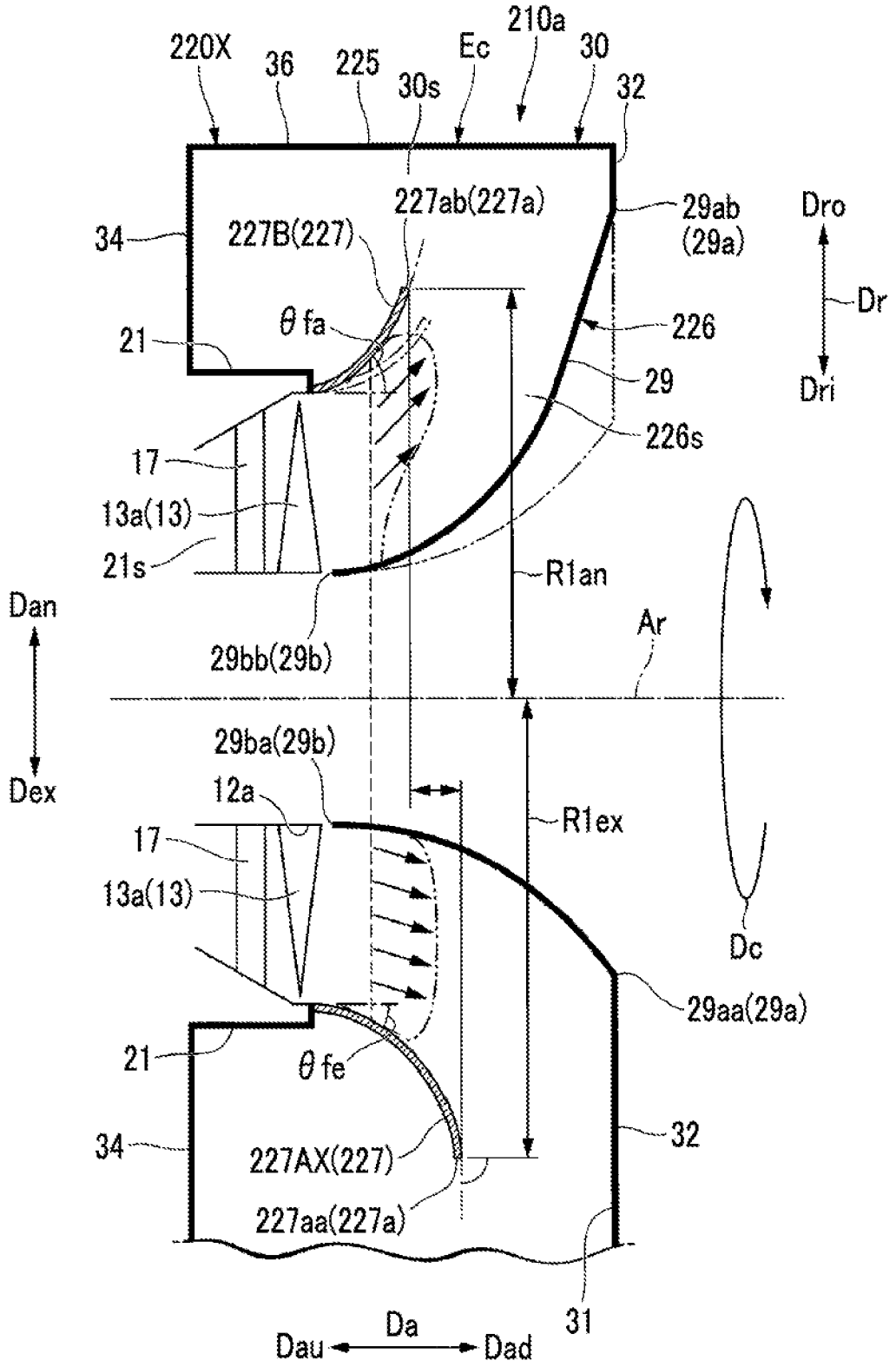
FIG. 6 is a view corresponding to FIG. 2 in a first modification example of the second embodiment of the present invention.
Figure 7:
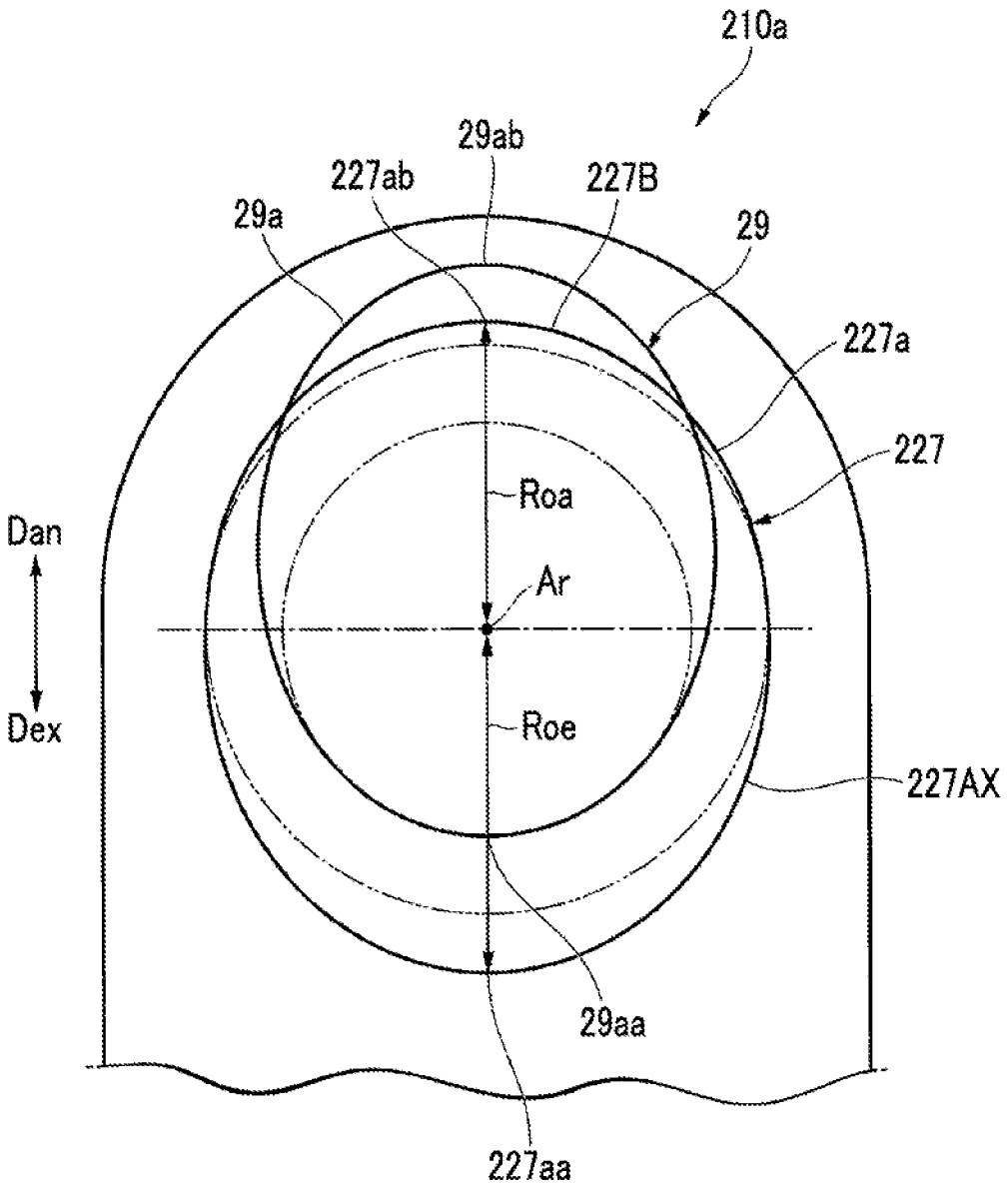
FIG. 7 is a view corresponding to FIG. 3 in the first modification example of the second embodiment of the present invention.

FIG. 6 is a view corresponding to FIG. 2 in the first modification example of the second embodiment of the present invention. FIG. 7 is a view corresponding to FIG. 3 in the first modification example of the second embodiment of the present invention.

As illustrated in FIGS. 6 and 7, similar to the above-described second embodiment, a casing 220X of the first steam turbine section 210*a* in the first modification example of the second embodiment has the inner casing 21 and the exhaust casing 225. The exhaust casing 225 has the diffuser 226 and the outer casing 30.

The diffuser 226 is disposed on the axial downstream side Dad of the inner casing 21, and allows the first space 21*s* and the second space 30*s* to communicate with each other. The diffuser 226 forms an annular diffuser space 226*s* that gradually moves radially outward as going toward the axial downstream side Dad. The steam that has flowed out from the last rotor blade row 13*a* of the turbine rotor 11 toward the axial downstream side Dad flows into the diffuser space 226*s*.

The diffuser 226 includes a flow guide 227 that defines the edge of the diffuser space 226*s* on the radial outer side Dro, and the bearing cone 29 that defines the edge of the diffuser space 226*s* on the radial inner side Dri.

The flow guide 227 has a cylindrical shape extending from the end edge of the inner casing 21 on the axial downstream side Dad as going toward the axial downstream side Dad. The flow guide 227 has a ring-shaped cross section perpendicular to the axis Ar, and the diameter thereof gradually widens as going toward the axial downstream side Dad. The flow guide 227 in the second embodiment is connected to the inner casing 21.

In the flow guide 227 according to the first modification example of the second embodiment, similar to the first and second embodiments, the cross-sectional shape including the axis Ar is formed into a curved surface shape protruding toward the axis Ar. Furthermore, in the second embodiment, the surface length of the flow guide 27 in the cross section including the axis Ar of the flow guide 27 is formed to be longer on the exhaust side Dex than that on the opposite exhaust side Dan. Accordingly, while the angle of the tangent (illustrated by a chain line in FIG. 6) at the end edge 227*a* is approximately 90 degrees on the exhaust side Dex, the angle on the opposite exhaust side Dan is smaller than that on the exhaust side Dex.

The flow guide 227 includes a first guide section 227AX on the exhaust side Dex of the axis Ar, and includes the second guide section 227B on the opposite exhaust side Dan of the axis Ar. The first guide section 227AX and the second guide section 227B have an asymmetric shape.

The position of the end edge 227*a* on the exhaust side Dex in the axial direction Da is disposed on the axial downstream side Dad from the position of the end edge 227*a* on the opposite exhaust side Dan. At the end edge 227*a* of the flow guide 227, the distance R1*ex* between the axis Ar and the exhaust side guide end portion 227*aa* positioned on the most exhaust side Dex is longer than the distance R1*an* between the axis Ar and the opposite exhaust side guide end portion 227*ab* positioned on the most opposite exhaust side Dan in the radial direction Dr.

As illustrated in FIG. 7, the end edge 227*a* of the flow guide 227 in the second embodiment is formed in an oval shape which is elongated to the opposite exhaust side Dan or elongated to the exhaust side Dex, more than the distance at which the distance between the axis Ar and the end edge 227*a* is the shortest. A length Roe of the oval in the first guide section 227AX in the elongated radial direction is formed to be longer than a length Roa of the oval in the second guide section 227B in the elongated radial direction.

As illustrated in FIG. 6, in the cross section including the axis Ar, the angle of the tangent (illustrated by the chain line in FIG. 6) of the flow guide 227 at the same position in the axial direction Da is greater on the opposite exhaust side Dan than that on the exhaust side Dex. Specifically, at the same position in the axial direction Da, the angle θfe of the tangent of the first guide section 227AX is equal to or greater than 0 degree and smaller than the angle θfa of the tangent of the second guide section 227B (θfa>θfe≥0). Here, in FIG. 6, a comparative example in which the second guide section 227B is formed at the same angle θfe as the first guide section 227AX on the opposite exhaust side Dan is illustrated by the two-dot chain line. In other words, by forming the above-described second guide section 227B, the dimension of the second guide section 227B in the axial direction Da is shorter than the dimension of the first guide section 227AX in the axial direction Da. Furthermore, the position of the opposite exhaust side guide end portion 227*ab* of the second guide section 227B can be disposed on the axial upstream side Dau and on the radial outer side Dro compared to the comparative example in which the angle θfe is set.

Since the bearing cone 29 has the same configuration as that of the first and second embodiments, a detailed description thereof will be omitted.

Therefore, according to the first modification example of the above-described second embodiment, it is possible to suppress the decrease in the flow path cross-sectional area of the diffuser space 226*s* on the opposite exhaust side Dan to be smaller than the flow path cross-sectional area on the exhaust side Dex. Therefore, it is possible to expand the effective flow path area as the diffuser space 226*s* at the outlet of the diffuser 226, and to improve the pressure recovery performance of the diffuser 226.

Second Modification Example of Second Embodiment

Figure 8:
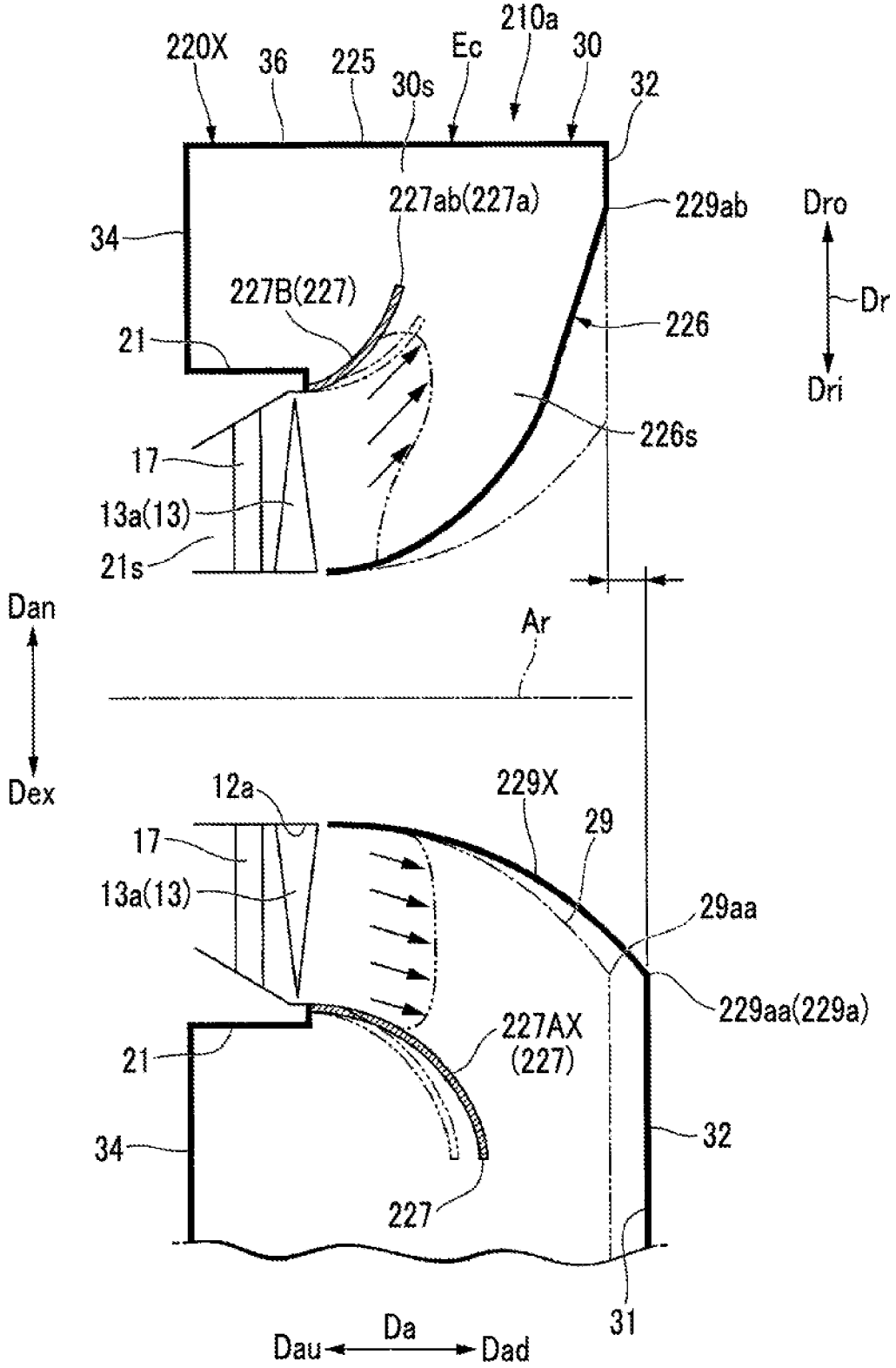
FIG. 8 is a view corresponding to FIG. 2 in a second modification example of the second embodiment of the present invention.
Figure 9:
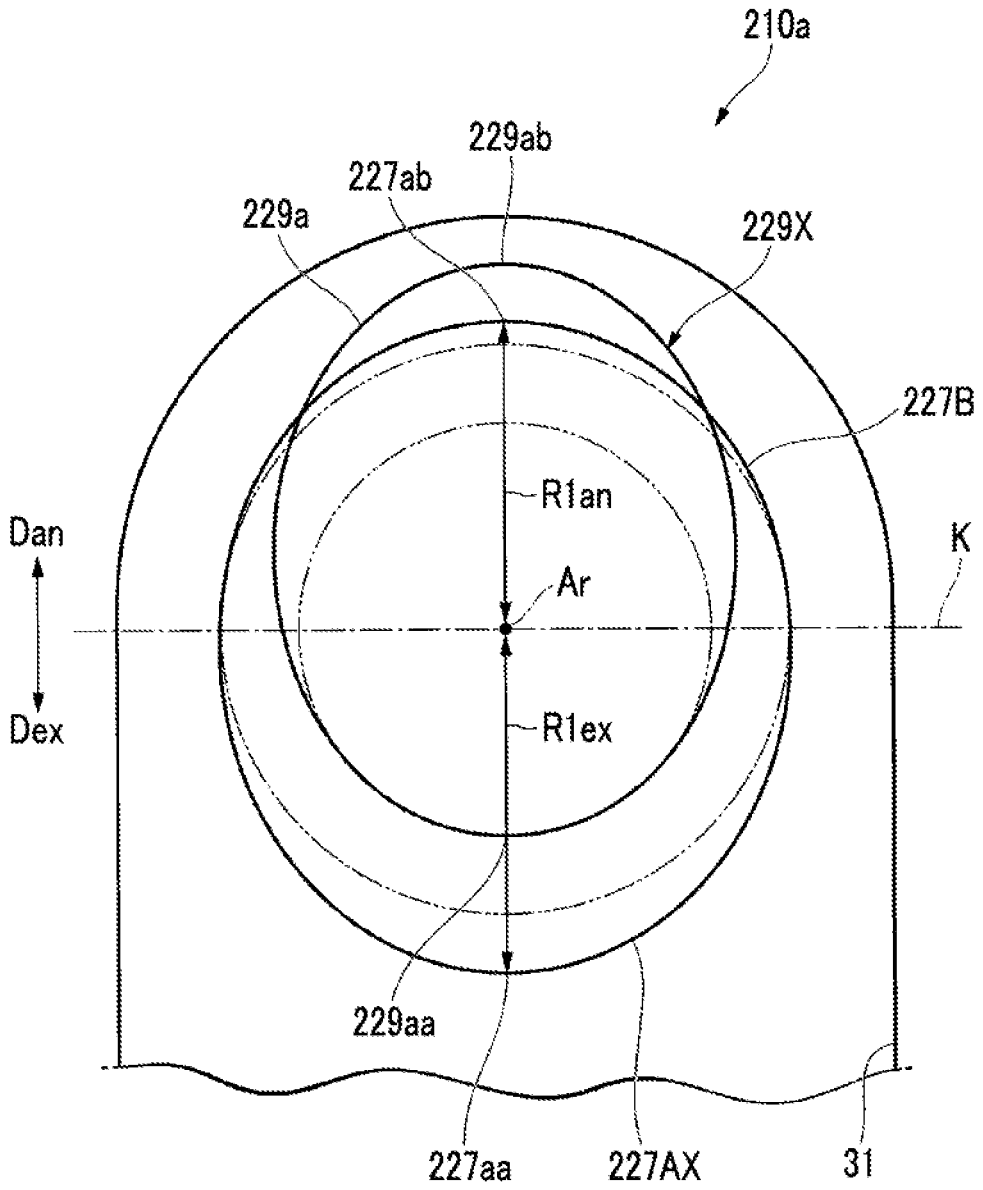
FIG. 9 is a view corresponding to FIG. 3 in the second modification example of the second embodiment of the present invention.

FIG. 8 is a view corresponding to FIG. 2 in the second modification example of the second embodiment of the present invention. FIG. 9 is a view corresponding to FIG. 3 in the second modification example of the second embodiment of the present invention.

In the first modification example of the above-described second embodiment, the first guide section 227AX is formed to extend to the axial downstream side Dad more than the first guide section 227A of the second embodiment. Similar to the flow guide 227 of the first modification example, for example, as in the second modification example illustrated in FIGS. 8 and 9, a bearing cone 229X on the exhaust side Dex may be formed to extend to the axial downstream side Dad more than the bearing cone 29 (illustrated by the two-dot chain line in FIG. 8) on the exhaust side Dex of the second embodiment.

In other words, a first cone end portion 229*aa* on the exhaust side Dex of the bearing cone 229X may be disposed on the axial downstream side Dau from a second cone end portion 229*ab* on the opposite exhaust side Dan. In addition, a case where the position of the first cone end portion 229*aa* in the radial direction Dr in the second modification example is the same as the position of the first cone end portion 29*aa* in the radial direction Dr in the first and second embodiments is illustrated, but may be closer to the axis Ar than the position.

Therefore, according to the second modification example of the second embodiment, the effective flow path area of the diffuser 226 on the exhaust side Dex of the diffuser 226 can be expanded to the axial downstream side Dad compared to the first modification example. Accordingly, the performance of the diffuser 26 can be improved.

Third Embodiment

Next, a third embodiment of the present invention will be described with reference to the drawings. The third embodiment is different from the above-described second embodiment in the shapes of the flow guide and the bearing cone on the opposite exhaust side Dan. Therefore, the same reference numerals will be given to the same parts as those of the above-described second embodiment, and the redundant description thereof will be omitted.

Figure 10:
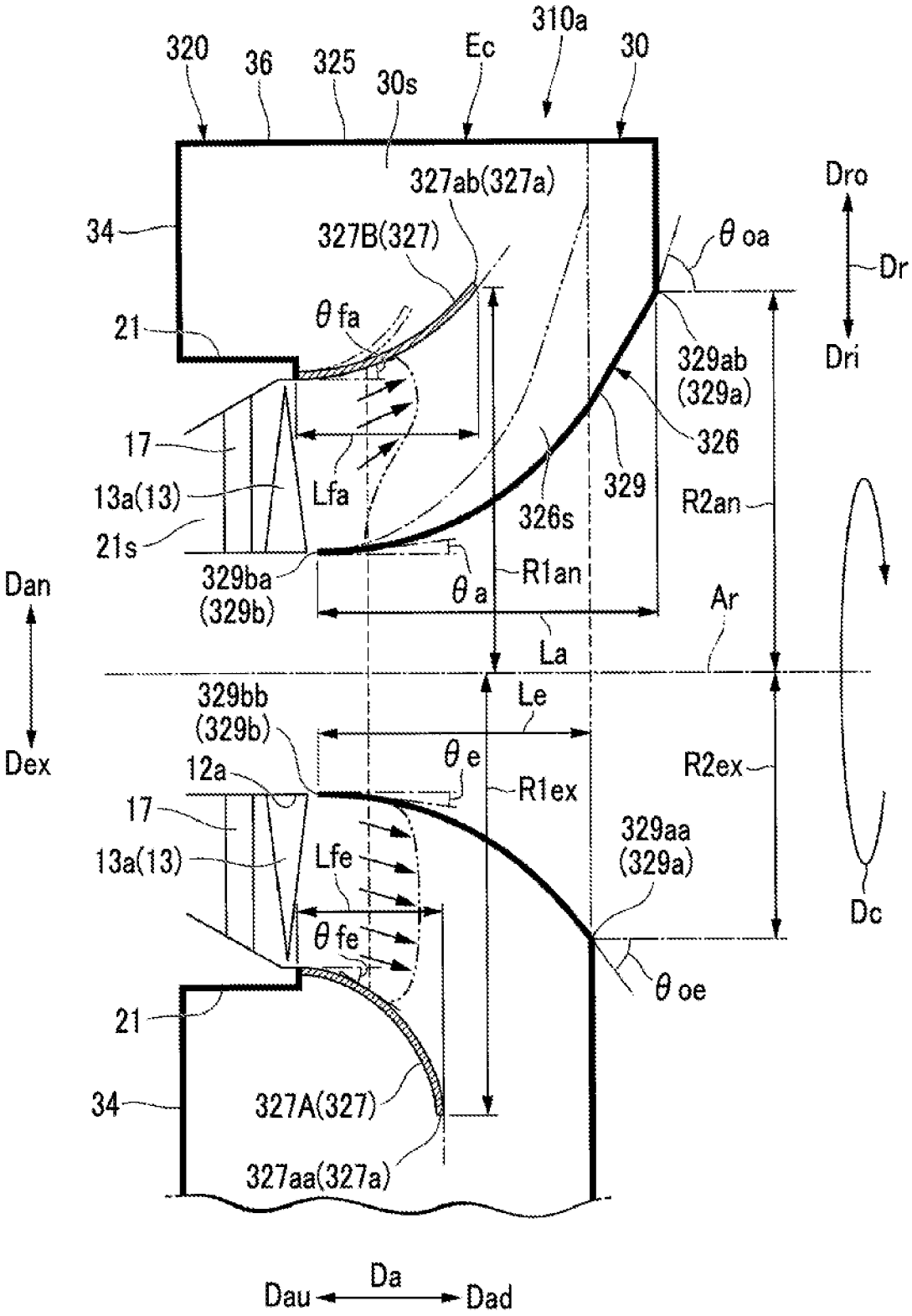
FIG. 10 is a view corresponding to FIG. 2 in a third embodiment of the present invention.
Figure 11:
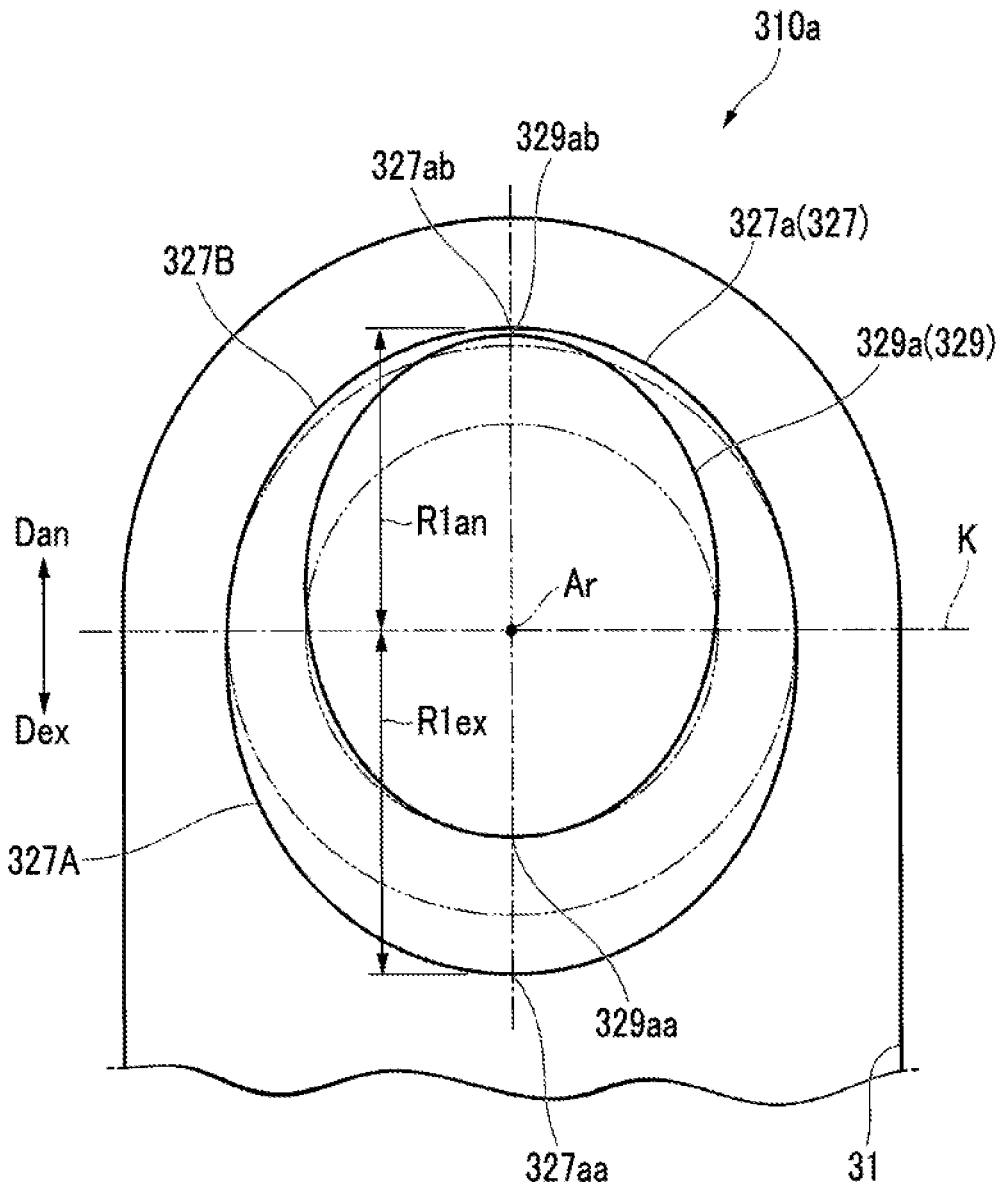
FIG. 11 is a view corresponding to FIG. 3 in the third embodiment of the present invention.

FIG. 10 is a view corresponding to FIG. 2 in the third embodiment of the present invention. FIG. 11 is a view corresponding to FIG. 3 in the third embodiment of the present invention.

As illustrated in FIGS. 10 and 11, similar to the above-described second embodiment, a casing 320 of a first steam turbine section 310*a* in the third embodiment has the inner casing 21 and an exhaust casing 325. Furthermore, the exhaust casing 325 has a diffuser 326 and the outer casing 30.

The diffuser 326 is disposed on the downstream side of the inner casing 21, and allows the first space 21*s* and the second space 30*s* to communicate with each other. The diffuser 326 forms the annular diffuser space 326*s* that gradually moves radially outward as going toward the axial downstream side Dad. The steam that has flowed out from the last rotor blade row 13*a* of the turbine rotor 11 toward the axial downstream side Dad flows into the diffuser space 326*s*.

The diffuser 326 includes a flow guide 327 that defines the edge of the diffuser space 326*s* on the radial outer side Dro, and the bearing cone 329 that defines the edge of the diffuser space 326*s* on the radial inner side Dri.

Similar to the flow guide 227 of the second embodiment, the flow guide 327 has a cylindrical shape extending from the end edge of the inner casing 21 on the axial downstream side Dad as going toward the axial downstream side Dad. The flow guide 327 has a ring-shaped cross section perpendicular to the axis Ar, and the diameter thereof gradually widens as going toward the axial downstream side Dad. Similar to the second embodiment, the flow guide 327 in the third embodiment is connected to the inner casing 21.

In the flow guide 327 according to the third embodiment, similar to the second embodiment, the cross-sectional shape including the axis Ar is formed into a curved surface shape protruding toward the axis Ar. Furthermore, in the third embodiment, the arc length in a cross section including the axis Ar of the flow guide 327 is formed to be longer on the exhaust side Dex than that on the opposite exhaust side Dan. Accordingly, while the angle of the tangent (illustrated by the chain line in FIG. 10) at an end edge 327*a* is approximately 90 degrees on the exhaust side Dex, the angle on the opposite exhaust side Dan is smaller than that on the exhaust side Dex.

The flow guide 327 includes a first guide section 327A on the exhaust side Dex of the axis Ar, and includes a second guide section 327B on the opposite exhaust side Dan of the axis Ar. The first guide section 327A and the second guide section 327B have an asymmetric shape.

The position of the end edge 327*a* on the exhaust side Dex in the axial direction Da is disposed on the axial upstream side Dau from the position of the end edge 327*a* on the opposite exhaust side Dan. At the end edges 327*a* of the flow guide 27, the distance R1*ex* between the axis Ar and an exhaust side guide end portion 327*aa* positioned on the most exhaust side Dex in the radial direction Dr is longer than the distance R1*an* between the axis Ar and an opposite exhaust side guide end portion 327*ab* positioned on the most opposite exhaust side Dan in the radial direction Dr (R1*ex*>R1*an*).

As illustrated in FIG. 11, the end edge 327*a* of the flow guide 327 in the third embodiment is formed in a long oval shape on the exhaust side Dex and on the opposite exhaust side Dan when viewed from the axial direction Da. The length R1*ex* of the first guide section 327A in the elongated radial direction is formed to be longer than the length Rian of the second guide section 327B in the elongated radial direction (R1*ex*>R1*an*). In other words, as illustrated in FIG. 10, the distance R1*an* between the axis Ar and the opposite exhaust side guide end portion 327*ab* on the opposite exhaust side Dan is shorter than the distance R1*ex* between the axis Ar and the exhaust side guide end portion 327*aa* of the flow guide 327 on the exhaust side Dex. In the cross section including the axis Ar illustrated in FIG. 10, the relationship between an inclination θfe of the tangent of the first guide section 327A and an inclination θfa of the tangent of the second guide section 327B at the same position in the axial direction Da satisfies θfe≥θfa≥0.

In the cross section including the axis Ar illustrated in FIG. 10, regarding the length of the flow guide 327 in the axial direction Da, a length Lfa of the second guide section 327B is longer than a length Lfe of the first guide section 327A (Lfa>Lfe). More specifically, the length of the flow guide 327 in the axial direction Da is formed to gradually increase as going toward the opposite exhaust side Dan from the exhaust side Dex. In FIG. 10, a comparative example in which the second guide section 327B is formed at the same angle θfe as that of the first guide section 327A on the opposite exhaust side Dan is illustrated by the two-dot chain line.

In the cross section including the axis Ar, the bearing cone 329 is formed in a curved surface shape protruding toward the axis Ar side. The end edge 329*a* of the bearing cone 329 on the axial downstream side Dad is formed in an oval shape in which a distance R2*an* between the axis Ar and a second cone end portion 329*ab* on the opposite exhaust side Dan is greater than a distance R2*ex* between the axis Ar and a first cone end portion 329*aa* on the exhaust side Dex in the direction (that is, the orthogonal direction about the axis Ar) orthogonal to the axis Ar.

In the cross section including the axis Ar, at the same position in the axial direction Da, the angle between the axis Ar and the tangent in the vicinity of the end edge 329*b* of the bearing cone 329 on the axial upstream side Dau is the same on the exhaust side Dex and on the opposite exhaust side Dan. In other words, the angle θe of the tangent of the bearing cone 329 at an end portion 329*bb* on the exhaust side Dex is the same as the angle θa of the tangent of the bearing cone 329 at an end portion 329*ba* on the opposite exhaust side Dan. More specifically, the angles θa and θe of the tangent satisfy θa=θe≥0.

In the axial direction Da, the bearing cone 329 on the opposite exhaust side Dan extends to the axial downstream side Dad more than the bearing cone 329 on the exhaust side Dex. In other words, a length La of the bearing cone 329 on the opposite exhaust side Dan in the axial direction Da is longer than a length Le of the bearing cone 329 on the exhaust side Dex (La>Le). In addition, since the length of the bearing cone 329 in the axial direction Da is different on the exhaust side Dex and on the opposite exhaust side Dan, the angle θoa of the tangent at the second cone end portion 329*ab* on the opposite exhaust side Dan is greater than the angle θoe of the tangent at the first cone end portion 329*aa* on the exhaust side Dex (θoa>θoe).

Therefore, according to the above-described third embodiment, the length of the bearing cone 329 and the length of the flow guide 327 on the opposite exhaust side Dan can be respectively increased. Accordingly, the length of the diffuser space 326*s* on the opposite exhaust side Dan can be increased. As a result, it is possible to suppress the occurrence of the backflow in the flow of the steam on the bearing cone 329 side, and to improve the pressure recovery performance of the diffuser 326. On the other hand, since the dimension of the exhaust hood Ec in the axial direction Da does not increase on the exhaust port 31 side where there is a possibility that the condenser (not illustrated) or the like is disposed, the influence on the degree of freedom of arrangement of the condenser and the like can be suppressed.

Fourth Embodiment

Next, a fourth embodiment of the present invention will be described with reference to the drawings. The fourth embodiment is different from the above-described first embodiment in the flow guide about the axis. Therefore, the same reference numerals will be given to the same parts as those of the above-described first embodiment, and the redundant description thereof will be omitted.

Figure 12:
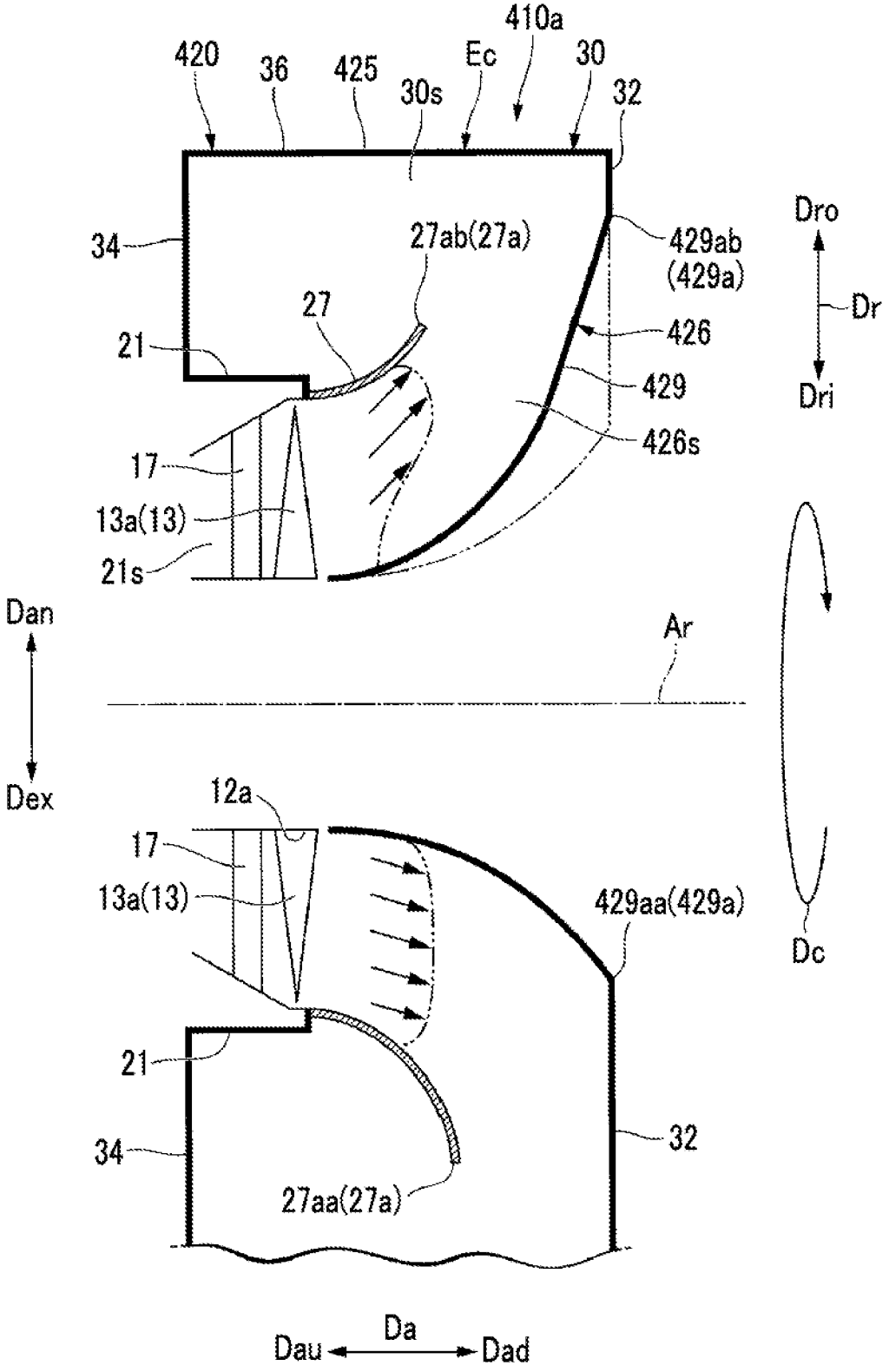
FIG. 12 is a view corresponding to FIG. 2 in a fourth embodiment of the present invention.
Figure 13:
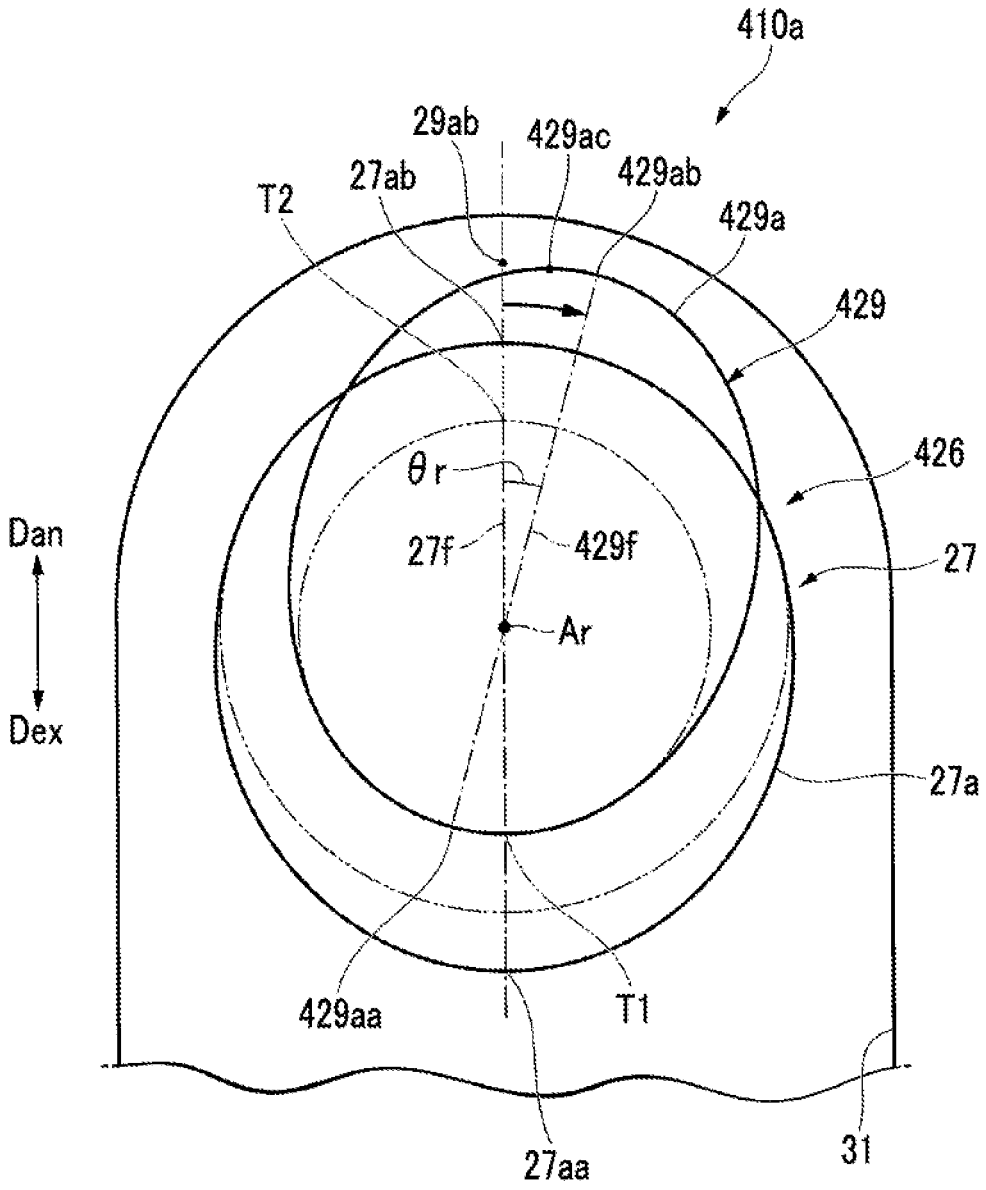
FIG. 13 is a view corresponding to FIG. 3 in the fourth embodiment of the present invention.

FIG. 12 is a view corresponding to FIG. 2 in the fourth embodiment of the present invention. FIG. 13 is a view corresponding to FIG. 3 in the fourth embodiment of the present invention.

As illustrated in FIG. 12, similar to the above-described first embodiment, a casing 420 of a first steam turbine section 410*a* in the fourth embodiment has the inner casing 21 and an exhaust casing 425. Furthermore, the exhaust casing 425 has a diffuser 426 and the outer casing 30.

The diffuser 426 is disposed on the axial downstream side Dad of the inner casing 21, and allows the first space 21*s* and the second space 30*s* to communicate with each other. The diffuser 426 forms the annular diffuser space 426*s* that gradually moves radially outward as going toward the axial downstream side Dad. The steam that has flowed out from the last rotor blade row 13*a* of the turbine rotor 11 toward the axial downstream side Dad flows into the diffuser space 426*s*.

The diffuser 426 includes a flow guide 27 that defines the edge of the diffuser space 426*s* on the radial outer side Dro, and the bearing cone 429 that defines the edge of the diffuser space 426*s* on the radial inner side Dri. Since the flow guide 27 has the same configuration as the flow guide 27 of the first embodiment, the detailed description thereof will be omitted.

The bearing cone 429 is different from the bearing cone 29 of the first embodiment in the angle in the circumferential direction Dc. An end edge 429*a* of the bearing cone 429 on the axial downstream side Dad has an oval shape when viewed from the axial direction Da.

As illustrated in FIG. 13, at the end edge 429*a* of the bearing cone 429, a second cone end portion 429*ab* on the opposite exhaust side Dan where the distance from the axis Ar is the largest is disposed at a position shifted forward in the rotational direction of the rotor shaft 12 from the position (that is, a position farthest from the exhaust port 31 in the circumferential direction Dc about the axis Ar) of an edge portion 429*ac* on the most opposite exhaust side Dan at the end edge 429*a* of the bearing cone 429. In other words, based on the position (the position on the straight line illustrated by the one-dot chain line in FIG. 13) of the second cone end portion 29*ab* of the first embodiment, the position of the second cone end portion 429*ab* is shifted forward in the rotational direction of the rotor shaft 12 in the circumferential direction Dc from the position of the second cone end portion 29*ab*.

In other words, when viewed from the axial direction Da, with respect to a virtual line 27*f* which is a straight line passing through the exhaust side guide end portion 27*aa*, the opposite exhaust side guide end portion 27*ab*, and the axis Ar in the flow guide 27, a virtual line 429*f* passing through a first cone end portion 429*aa*, the second cone end portion 429*ab*, and the axis Ar is disposed at a position shifted forward in the rotational direction of the rotor shaft 12. Although the virtual line 27*f* passing through the exhaust side guide end portion 27*aa* and the opposite exhaust side guide end portion 27*ab* in the flow guide 27 has been described as a reference position in the circumferential direction Dc, for example, on any virtual circle (true circle) about the axis Ar, the straight line passing through an exhaust side end portion T1 which is the most exhaust side Dex, an opposite exhaust side end portion T2 which is the most opposite exhaust side Dan, and the axis Ar respectively may be the virtual line 27*f*.

Here, an angle θr between the virtual line 27*f* and the virtual line 429*f* is smaller than 45 degrees and greater than 0 degrees. Furthermore, the angle θr may be smaller than 30 degrees, and can be smaller than 20 degrees. The angle θr may be determined, for example, in accordance with a turning component included in the flow of steam discharged from the first space 21*s*.

Therefore, according to the fourth embodiment, in a case where a flow of the steam including the turning component from the last rotor blade row 13*a* of the turbine rotor 11 to the diffuser 426, at the bearing cone 429, the second cone end portion 429*ab* having the largest distance from the axis Ar can be disposed at a position at which a backflow region is most likely to be generated. Therefore, the pressure loss in the diffuser 426 can be effectively reduced.

The present invention is not limited to the configuration of each of the above-described embodiments, and the design can be changed without departing from the gist of the present invention.

For example, in each of the above-described embodiments, the exhaust hood of the steam turbine has been described as an example, but the present invention can be applied to, for example, an exhaust hood of a gas turbine or a turbomachine.

INDUSTRIAL APPLICABILITY

According to the exhaust hood and the steam turbine of the present invention, the performance can be improved by reducing the pressure loss.

REFERENCE SIGNS LIST

10*a*, 210*a*, 310*a*, 410*a* first steam turbine section
10*b* second steam turbine section
11 rotor

11 turbine rotor
12 rotor shaft
12*a* outer peripheral surface
13 rotor blade row
13*a* last rotor blade row
17 stator blade row
18 bearing
19 steam inlet duct
20, 220, 320, 420 casing
21 inner casing
21*o* outer peripheral surface
21*s* first space
25, 225, 325, 425 exhaust casing
26, 226, 326, 426 diffuser
26*s*, 226*s*, 326*s*, 426*s* diffuser space
27, 227, 327 flow guide
27*a*, 227*a*, 327*a* end edge
27*aa*, 227*aa*, 327*aa* exhaust side guide end portion
27*ab*, 227*ab*, 327*ab* opposite exhaust side guide end portion
27*f* virtual line
29, 229, 229X, 329, 429 bearing cone
29*a*, 329*a*, 429*a* end edge
29*aa*, 229*aa*, 329*aa*, 429*aa* first cone end portion
29*ab*, 229*ab*, 329*ab*, 429*ab* second cone end portion
29*b*, 329*b* end edge
29*ba*, 329*ba* end portion
29*bb*, 329*bb* end portion
30 outer casing
30*s* second space
31 exhaust port
32 downstream end plate
34 upstream end plate
36 side peripheral plate
227A, 227AX, 327A first guide section
227B, 327B second guide section
429*ac* edge portion
429*f* virtual line
Ec exhaust hood
ST steam turbine

The invention claimed is:

1. An exhaust hood comprising:

an inner casing that surrounds a rotor from an outside in a radial direction about an axis of a rotor shaft, and forms a first space in which a fluid flows in a direction in which the axis extends between the rotor and the inner casing;

an outer casing that surrounds the rotor and the inner casing, forms a second space to which the fluid flowing through the first space is discharged between the inner casing and the outer casing, and has an outlet on a first side in a direction orthogonal to the axis; and a diffuser that is disposed on a downstream side of the inner casing to form a diffuser space communicating with the first space, is oriented radially outward as going toward the downstream side, and allows the first space and the second space to communicate with each other, wherein the diffuser is provided with a bearing cone that forms a cylindrical shape extending to a downstream side in an axial direction to be continuous with an outer peripheral surface of the rotor shaft that forms the first space and has a diameter that gradually widens as going toward the downstream side in the axial direction, and wherein an end edge on the downstream side of the bearing cone forms an oval shape in which, on a major axis thereof extending in a direction orthogonal to the axial line, a distance between the axial line and a second cone end portion on a second side opposite to the first side is greater than a distance between the axial line and a first cone end portion on the first side, wherein in a cross-sectional view including the axis, an angle θe formed between the axis and a tangent on the upstream end of the bearing cone on a side of the bearing cone that is closer to the outlet than the axis is set, an angle θa formed between the axis and a tangent on the upstream end of the bearing cone on a side opposite the side of the bearing cone closer to the outlet than the axis is set, and the bearing cone satisfies the following expression: $\theta a > \theta e \geq 0$.

2. The exhaust hood according to claim 1, wherein the diffuser includes a flow guide that forms a cylindrical shape extending to the downstream side in the axial direction from an end edge on the downstream side of the inner casing and has a diameter that gradually widens as going toward the downstream side in the axial direction, wherein the flow guide includes a first guide section formed closer to the first side than the axis, and a second guide section formed closer to the second side than the axis, and wherein, in a cross-sectional view including the axis, an angle between the axis and a tangent of the second guide section is greater than an angle between the axis and a tangent of the first guide section which is at the same position as the second guide section in the axial direction.

3. The exhaust hood according to claim 2, wherein the first cone end portion on the first side is positioned on the downstream side in the axial direction from the second cone end portion on the second side.

4. A steam turbine comprising:

the exhaust hood according to claim 2.

5. A steam turbine comprising:

the exhaust hood according to claim 3.

6. The exhaust hood according to claim 1, wherein the diffuser includes a flow guide that forms a cylindrical shape extending to the downstream side in the axial direction from an end edge on the downstream side of the inner casing and has a diameter that gradually widens as going toward the downstream side in the axial direction, wherein the flow guide includes a first guide section formed closer to the first side than the axis, and a second guide section formed closer to the second side than the axis, wherein, in a cross-sectional view including the axis, a radial distance between the axis and a second side guide end portion positioned on the second side of the second guide section and furthest from the outlet is greater than a radial distance between the axis and the first guide section which is at the same position as the second side guide end portion in the axial direction, and wherein an angle between the axis and a tangent at the second side guide end portion is greater than an angle between the axis and a tangent of the first guide section which is at the same position as the second side guide end portion in the axial direction.

7. The exhaust hood according to claim 6, wherein the first cone end portion on the first side is positioned on the downstream side in the axial direction from the second cone end portion on the second side.

8. A steam turbine comprising:
the exhaust hood according to claim 7.

9. A steam turbine comprising:
the exhaust hood according to claim 6.

10. The exhaust hood according to claim 1,
wherein, in the bearing cone, the second cone end portion is disposed at a position forward in a rotational direction of the rotor shaft along the end edge with respect to a position on the second side and furthest from the outlet.

11. A steam turbine comprising:
the exhaust hood according to claim 10.

12. A steam turbine comprising:
the exhaust hood according to claim 1.

* * * * *